United States Patent [19]

Yoshida et al.

[11] Patent Number: 5,011,367

[45] Date of Patent: Apr. 30, 1991

[54] FUEL PUMP

[75] Inventors: Shigeru Yoshida; Yoshimasa Ito, both of Obu, Japan

[73] Assignee: Aisan Kogyo Kabushiki Kaisha, Obu, Japan

[21] Appl. No.: 467,566

[22] Filed: Jan. 19, 1990

[30] Foreign Application Priority Data

Jan. 31, 1989 [JP] Japan ..... 1-10395[U]

[51] Int. Cl.[5] ..... F04D 5/00

[52] U.S. Cl. ..... 415/55.1; 415/55.5

[58] Field of Search ..... 415/52.1, 55.1, 55.2, 415/55.3, 55.4, 55.5, 55.6, 55.7

[56] References Cited

U.S. PATENT DOCUMENTS

| | | | |
|---|---|---|---|
| 1,665,687 | 4/1928 | Derrick | 415/55.4 |
| 1,689,579 | 10/1928 | Burks | 415/55.5 |
| 1,973,669 | 9/1934 | Spoor | 415/55.7 |
| 2,671,404 | 3/1954 | Krueger | 415/55.7 |
| 3,168,871 | 2/1965 | Sieghartner | 415/55.6 |
| 4,493,620 | 1/1985 | Takei et al. | 415/55.5 |

FOREIGN PATENT DOCUMENTS

| | | | |
|---|---|---|---|
| 47-17941 | 5/1972 | Japan . | |
| 4717942 | 5/1972 | Japan . | |
| 57-157055 | 9/1982 | Japan . | |
| 150098 | 7/1987 | Japan | 415/55.1 |
| 1-177489 | 7/1989 | Japan . | |
| 1-177491 | 7/1989 | Japan . | |

*Primary Examiner*—John T. Kwon

*Attorney, Agent, or Firm*—Dennison, Meserole, Pollack & Scheiner

[57] ABSTRACT

A fuel pump including an impeller having a plurality of vanes at an outer circumference thereof and a well member surrounding the vanes and formed with a fuel grooves to define a pump chamber, wherein a portion of an edge of the fuel groove intersecting the vanes is chamfered. Accordingly, it is possible to reduce an impeller noise caused by the sudden shearing of the fuel flow in the pump chamber when the vanes of the impeller cross the edge of the fuel groove, thereby greatly improving the silentness in an automobile compartment.

13 Claims, 13 Drawing Sheets

FUEL PUMP

BACKGROUND OF THE INVENTION

The present invention relates to a fuel pump for use with an automobile, for example, and more particularly to a fuel pump which may reduce a noise generating therefrom.

FIGS. 11 to 18 show a fuel pump in the prior art. Referring to FIG. 11, reference numeral 2 designates a fuel pump substantially vertically mounted in a fuel tank 4 through a bracket 6.

Referring to FIG. 12, the fuel pump 2 is generally constructed of a cylindrical housing 8, a motor section 10 mounted in the housing 8 at its substantially upper portion, and a pump section 14 fixedly mounted below the motor section 10 with a cover member 12 interposed therebetween.

A motor shaft 18 for a rotor 16 of an electric motor constituting the motor section 10 is inserted through a central hole of the cover member 12 with a bearing 17 mounted therein. The motor shaft 18 extends into the pump section 14, and first and second impellers 20 and 22 are mounted on the motor shaft 18 so that they may be rotated with the motor shaft 18 but they are slidable in the axial direction of the motor shaft 18. As shown in FIGS. 13 and 14, each of the first and second impellers 20 and 22 is formed at its outer circumference with a plurality of recesses 24 to form a plurality of vanes 25. The vanes 25 are formed in upper and lower lines in such a manner that the upper vanes 25*a* are arranged alternately with respect to the lower vanes 25*b*. Referring back to FIG. 12, a housing body 26 is fixed by means of screws 32 to the cover member 12 through a pair of annular spacers 30 and 31 and an intermediate plate 28 fixed between the annular spacers 30 and 31. There are defined first and second annular gaps between the inner circumference of the lower spacer 30 and the outer circumference of the first impeller 20 and between the inner circumference of the upper spacer 31 and the outer circumference of the second impeller 22. The housing body 26 is formed on its upper surface with a first fuel groove 40, and the intermediate plate 28 is formed on its lower surface with a second fuel groove 38, thus defining a first pump chamber 42 having a C-shaped cross section around the outer circumference of the first impeller 20 by the first annular gap, the first fuel groove 40 and the second fuel groove 38. Similarly, the intermediate plate 28 is formed on its upper surface with a third fuel groove 36, and the cover member 12 is formed on its lower surface with a fourth fuel groove 34, thus defining a second pump chamber 44 having a C-shaped cross section around the outer circumference of the second impeller 22 by the second annular gap, the third fuel groove 36 and the fourth fuel groove 34. The first pump chamber 42 and the second pump chamber 44 are communicated with each other through a communication hole formed through the intermediate plate 28. The first pump chamber 42 is communicated at its upstream end with an inlet port 48 formed through the housing body 26 which inlet port 48 is communicated into the fuel tank 4, while the second pump chamber 44 is communicated at its downstream end with an outlet port 46 formed through the cover member 12 which outlet port 46 is communicated into the housing 8. Although not seen, there are defined small clearances between the upper surface of the housing body 26 and the lower surface of the first impeller 20 and between the upper surface of the first impeller 20 and the lower surface of the intermediate plate 28. Similarly, there are also defined small clearances between the upper surface of the intermediate plate 28 and the lower surface of the second impeller 22 and between the upper surface of the second impeller 22 and the lower surface of the cover member 12. Further, the cover member 12 and the housing body 26 are formed at the respective central portions with recesses 33 and 35, respectively, and the intermediate plate 28 is formed at its central portion with a through-hole 37. Each of the first and second impellers 20 and 22 is formed with four communication holes 39 for communicating the recesses 33 and 35 and the through-hole 37 with each other, thereby defining a pressure balancing chamber for maintaining the pressure constant at the small clearances mentioned above. Accordingly, the first and second impellers 20 and 22 can be smoothly rotated under the balanced fuel pressure.

In operation, when the first and second impellers 20 and 22 are rotated, the fuel pressure in the first pump chamber 42 is increased to feed the fuel into the second pump chamber 44 through the communication hole of the intermediate plate 28. The fuel pressure in the second pump chamber 44 is further increased to feed the fuel through the outlet port 46 into the housing 8. Thus, the fuel pressure in the pump chambers 42 and 44 is increased by the two-stage pressure increasing operation of the first and second impellers 20 and 22, so that the fuel is sucked from the inlet port 48 and is fed under pressure through the pump chambers 42 and 44 into the housing 8.

Referring to FIG. 13 which is a cross section taken along the line F—F in FIG. 12, the fuel groove 40 is formed in a C-shaped configuration on the upper surface of the housing body 26 along the inner circumference of the annular spacer 30. A portion of the inner circumference of the annular spacer 30 corresponding to a portion of the housing body 26 where the fuel groove 40 is not formed is radially inwardly projected to form a partition wall 50. An inner circumferential edge 52 of the partition wall 50 is formed arcuately in such a manner that a curvature of the inner circumferential edge 52 is substantially equal to a curvature of the outer circumferential edge of the first impeller 20. With this construction, there is no gap between the outer circumferential edge of the first impeller 20 and the inner circumferential edge 52 of the partition wall 50 of the spacer 30. Accordingly, the first pump chamber 42 is limited at its opposite ends by the partition wall 50. That is, the fuel sucked from the inlet port 48 and increased in pressure is struck against the side surface of the partition wall 50, and is then fed to the communication hole communicated with the second pump chamber 44.

Referring to FIGS. 15 and 16 which show a modification of the construction shown in FIGS. 13 and 14, the downstream end portions of the fuel grooves 38 and 40 are diverted outwardly in the radial direction of the housing body 26. This construction is described in detail in Japanese Patent Application No. 62-335239 filed by the present assignee (which corresponds to Japanese Patent Laid-open Publication No. 1-177491). Similar to the construction shown in FIGS. 13 and 14, the first pump chamber 42 is limited at its opposite ends by the partition wall 50. The fuel sucked from the inlet port 48 and increased in pressure is struck against the side surface of the partition wall 50, and is then fed to the communication hole.

Referring to FIGS. 17 and 18 which show another modification of the construction shown in FIGS. 13 and 14, the downstream end portions of the fuel grooves 38 and 40 are curved toward the center of the housing body 26. This construction is described in Japanese Patent Application No. 62-335237 filed by the present assignee (which corresponds to Japanese Patent Laid-open Publication No. 1-177489). The first impeller 20 is formed at its central portion with a plurality of windows 56 which are adapted to be communicated with the communication hole of the intermediate plate 28. Thus, the fuel increased in pressure in the first pump chamber 42 is fed through the windows 56 to the communication hole.

In the fuel pump 2 as mentioned above, there is generated a high-frequency noise (so-called impeller noise) having a high frequency to be represented by (the number of the vanes of the impeller)×(a rotating speed per second of the impeller). It is considered that the generation of such an impeller noise is caused by the following reasons. That is, since edges 154, 154*a* and 154*b* of the fuel grooves 38 and 40 angularly intersect the vanes 25 as shown in FIGS. 14, 16 and 18, the fuel in the fuel grooves 38 and 40 is suddenly sheared when the vanes 25 cross the intersecting edges 154, 154*a* and 154*b* of the fuel grooves 38 and 40. FIG. 19 shows an accoustic pressure measured at a point M (see FIG. 11) away by about 10 cm from the outer surface of the fuel tank in case of using the fuel pump as shown in FIG. 15 under the condition of (the number of the vanes)×(the rotating speed of the impeller)=3000/sec. As apparent from FIG. 19, the impeller noise appears at the frequency of 3 kHz.

Recently, the silentness in the compartment has been improved to result in a relatively large percentage of the impeller noise accoustically perceived in the compartment. Accordingly, it is required to reduce the impeller noise. As the fuel pump is normally located behind a rear seat as shown in FIG. 11, such requirement is increased particularly in a high-grade car which requires the silentness especially at the rear seat.

SUMMARY OF THE INVENTION

It is accordingly an object of the present invention to provide a fuel pump which may reduce the impeller noise caused by the sudden shearing of the fuel flow when the vanes of the impeller cross the edges of the fuel grooves, thereby greatly improving the silentness in the compartment.

According to the present invention, there is provided a fuel pump comprising impeller means having a plurality of vanes at an outer circumference thereof and a wall member surrounding said vanes and formed with fuel groove means to define a pump chamber, wherein a portion of an edge of said fuel groove intersecting said vanes is chamfered.

The invention will be more fully understood from the following detailed description and appended claims when taken with the drawings.

DETAILED DESCRIPTION OF THE PREFERRED EMBODIMENTS

Figure 1:
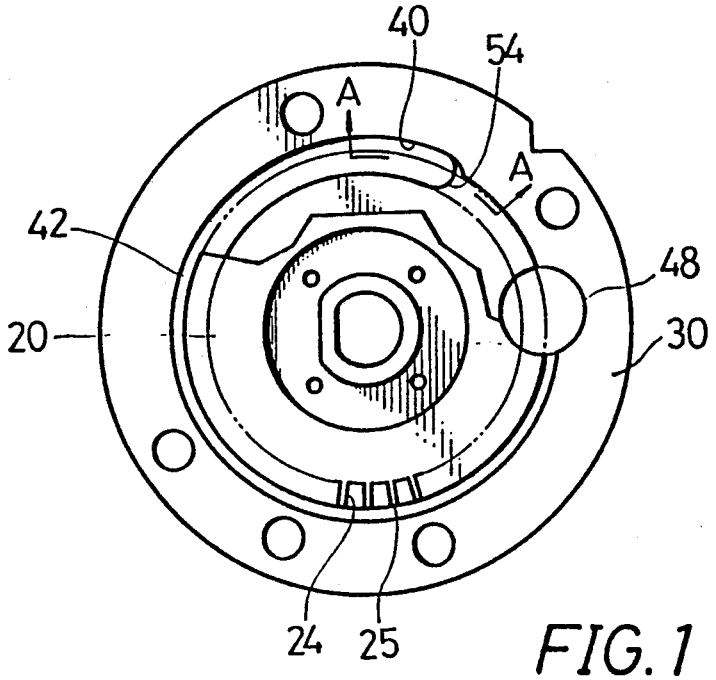
FIG. 1 is a horizontal sectional view of a first preferred embodiment of the fuel pump according to the present invention.

There will now be described some preferred embodiments of the present invention with reference to the drawings, wherein the same or corresponding parts as those shown in FIGS. 11 to 19 are designated by the same reference numerals, and the explanation thereof will be omitted.

Figure 2:
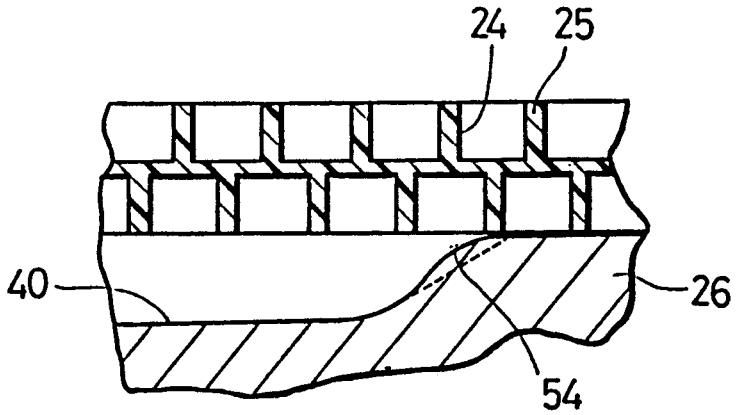
FIG. 2 is a cross section taken along the line A—A in FIG. 1.
Figure 13:
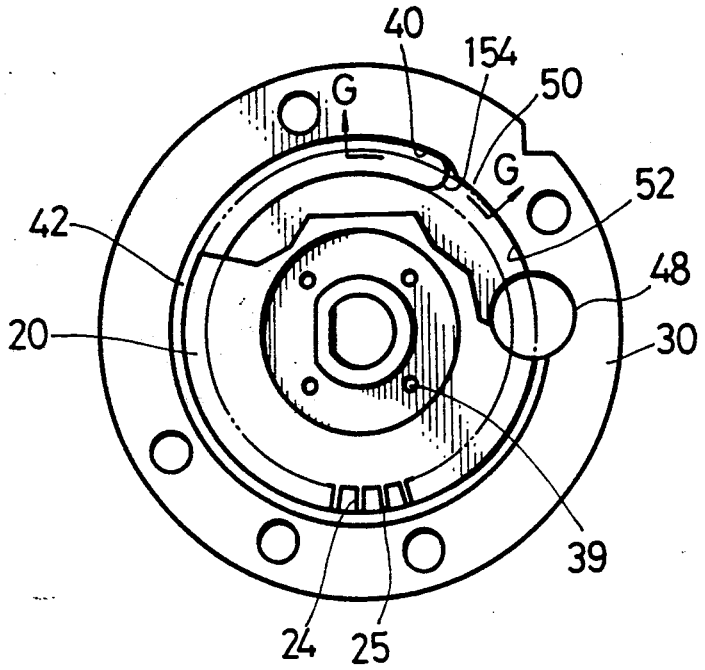
FIG. 13 PRIOR ART
FIG. 13 is a cross section taken along the line F—F in FIG. 12.
Figure 14:
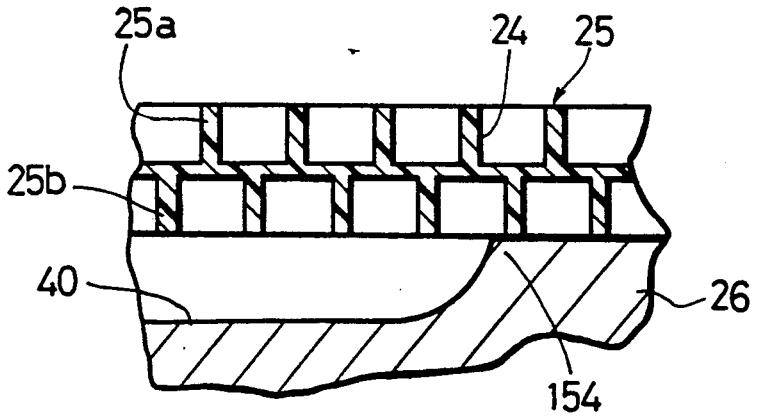
FIG. 14 PRIOR ART
FIG. 14 is a cross section taken along the line G—G in FIG. 13.

Referring to FIGS. 1 and 2 corresponding to FIGS. 13 and 14, an intersecting edge 54 of the fuel groove 40 intersecting the vanes 25 of the impeller 20 is chamfered as best seen in FIG. 2. Although not shown, an intersecting edge of the fuel groove 38 intersecting the vanes 25 of the impeller 20 is similarly chamfered.

With this construction, it is possible to prevent sudden shearing of the fuel flow having an increased pressure in the first pump chamber 42 when the vanes 25 cross the intersecting edges 54 of the fuel grooves 40 and 38. Accordingly, the impeller noise due to the sudden shearing of the fuel flow can be reduced.

Figure 3A:
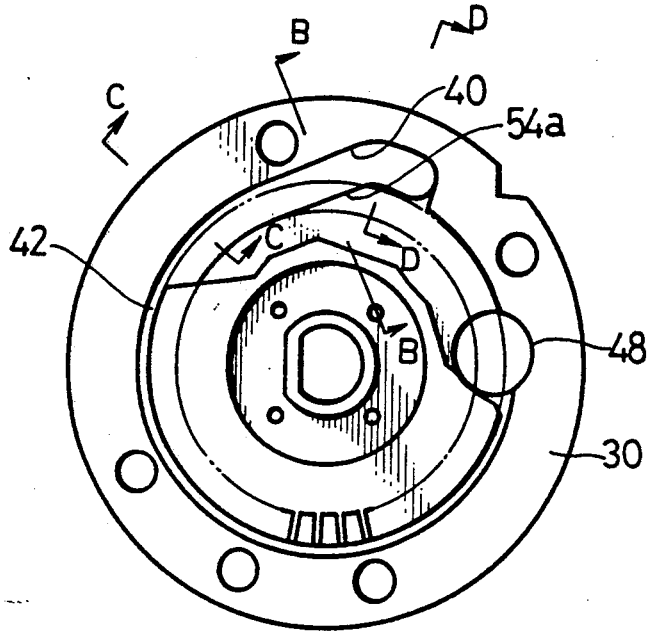
FIG. 3A is a view similar to FIG. 1, showing a second preferred embodiment of the present invention.
Figure 3B:
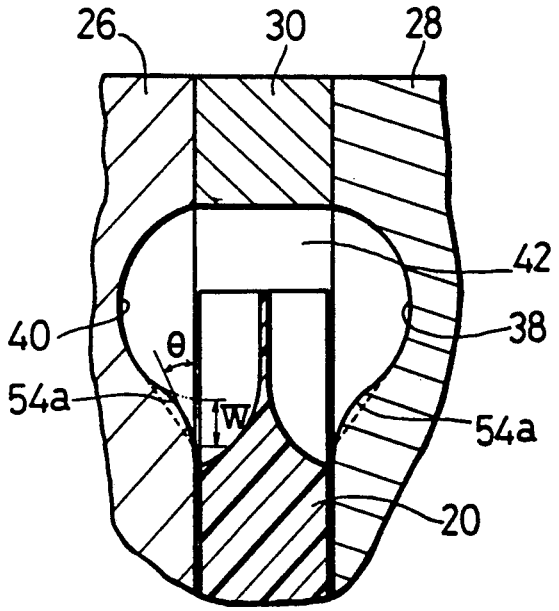
FIG. 3B is a cross section taken along the line B—B in FIG. 3A.
Figure 5:
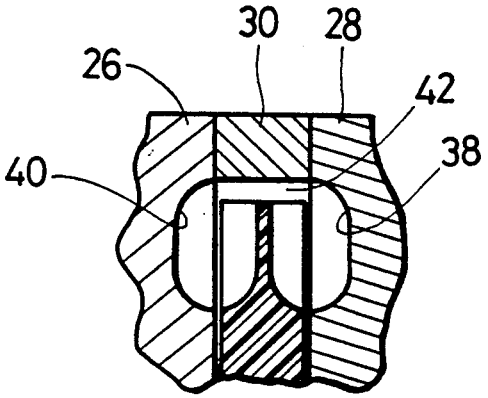
FIG. 5 is a cross section taken along the line C—C in FIG. 3A.
Figure 6:
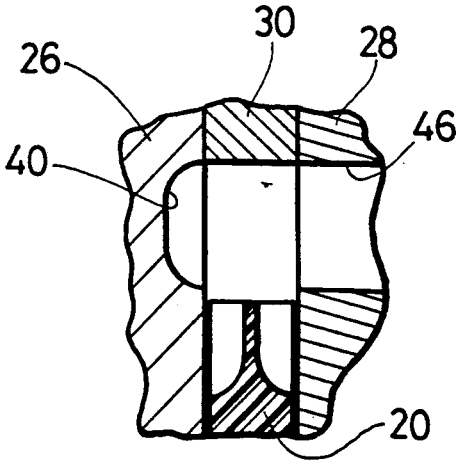
FIG. 6 is a cross section taken along the line D—D in FIG. 3A.
Figure 15:
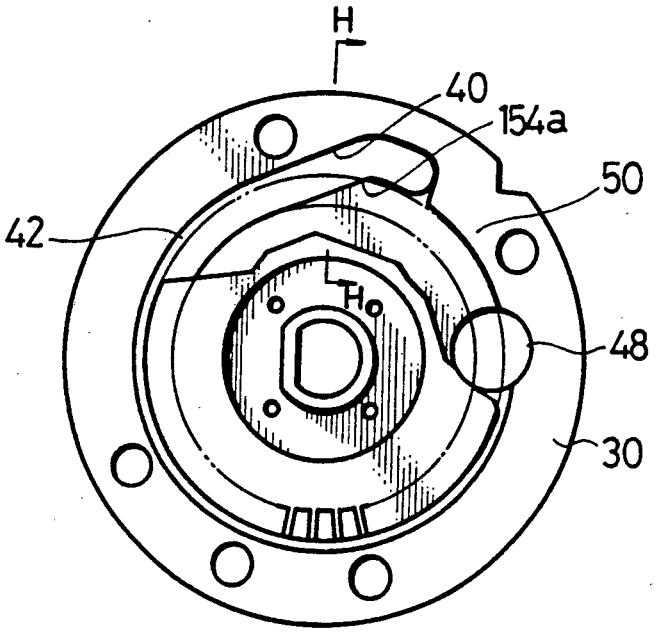
FIG. 15 PRIOR ART
FIG. 15 is a view similar to FIG. 13, showing a modified construction of the fuel pump in the prior art.
Figure 16:
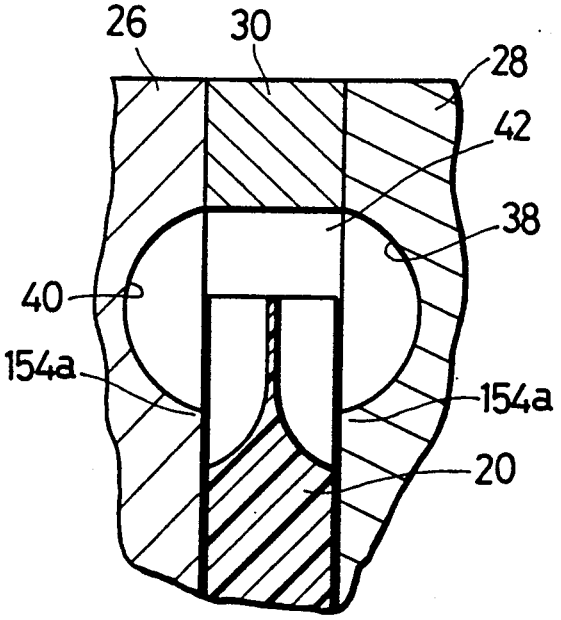
FIG. 16 PRIOR ART
FIG. 16 is a cross section taken along the line H—H in FIG. 15.

Referring next to FIGS. 3A and 3B corresponding to FIGS. 15 and 16, intersecting edges 54*a* of the fuel grooves 38 and 40 intersecting the vanes 25 are chamfered. As shown in FIGS. 5 and 6 which show the cross sections taken along the lines C—C and D—D, the edges of the fuel grooves 38 and 40 other than the intersecting edges 54*a* are not chamfered.

Figure 9:
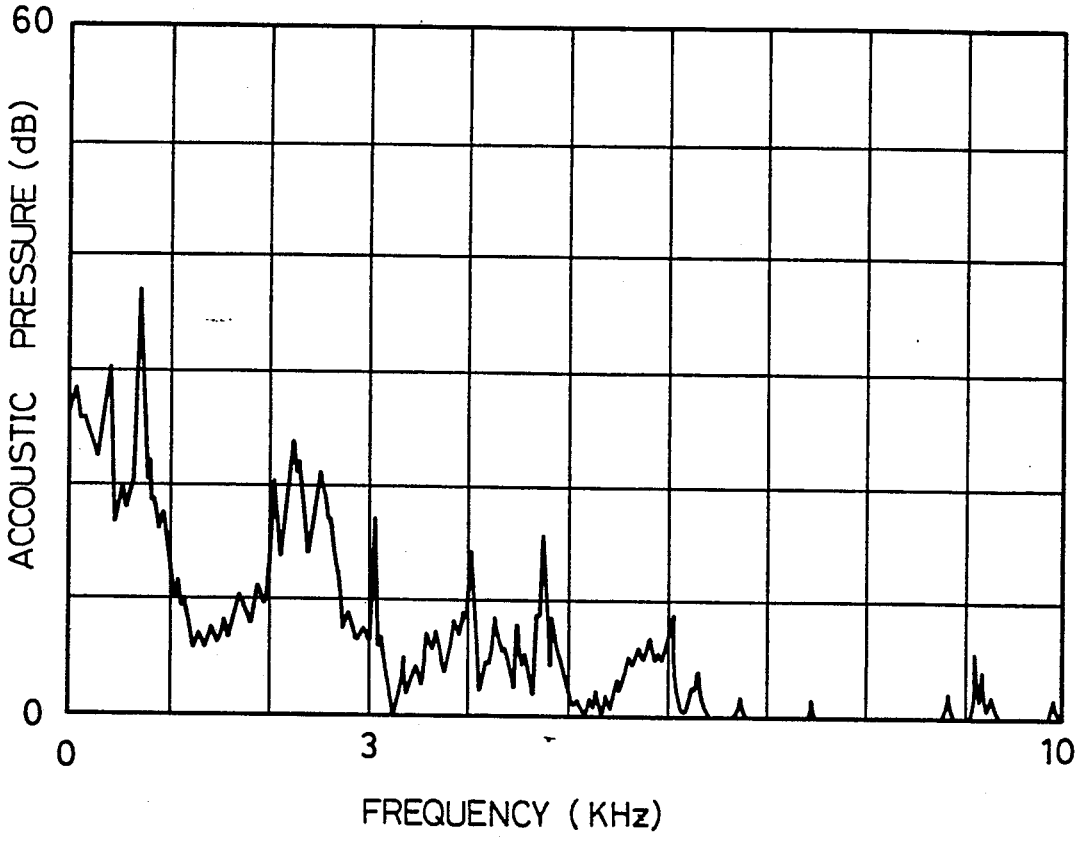
FIG. 9 is a graph showing the accoustic pressure as measured in the case that the present invention is applied to a single impeller.

FIG. 9 shows the result of measurement of an accoustic pressure as measured at the point M (see FIG. 11) away by about 10 cm from the outer surface of the fuel tank in the case of using the fuel pump of the second preferred embodiment. In comparison with FIG. 19, it is apparent that the accoustic pressure of the impeller noise (at the frequency of 3 kHz) is reduced to a half level.

Figure 4A:
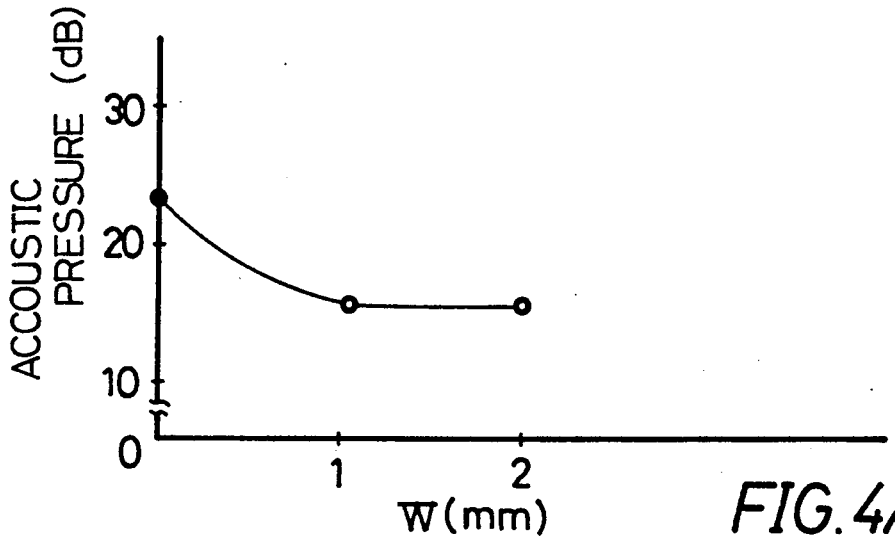
FIG. 4A is a graph showing the relationship between an accoustic pressure and a chamfering width according to the present invention.
Figure 4B:
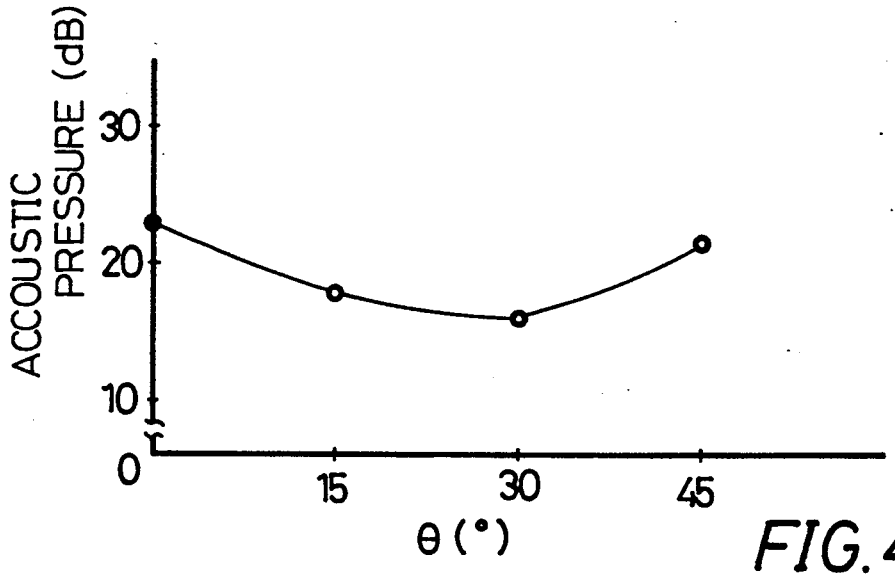
FIG. 4B is a graph showing the relationship between an accoustic pressure and a chamfering angle according to the present invention.

The inventors investigated the relationship between a chamfering construction of the intersecting edges 54*a* and the accoustic pressure of the impeller noise (at the frequency of 3 kHz). Under the condition where a chamfering angle $\theta$ is set to 30 degrees and a chamfering width W is varied, the accoustic pressure was measured. A phantom line shown in FIG. 3B indicates a fuel groove in the prior art. The measurement was carried out at the point M (see FIG. 11) away by about 10 cm from the outer surface of the fuel tank 4. FIG. 4A shows the result of measurement under the pump operational condition of 8.85 V×2.5 kg/cm$^2$. As apparent from FIG. 4A, the accoustic pressure becomes minimum when the chamfering width W ranges from 1.0 mm to 2.0 mm, and it is reduced by about 7 dB in comparison with the case that the chamfering width W is zero. Further, under the condition where the chamfering width W is set to 1 mm and the chamfering angle $\theta$ is varied, the accoustic pressure was measured in the like manner. As apparent from FIG. 4B, the accoustic pressure becomes minimum when the chamfering angle $\theta$ is 30 degrees, and it is reduced by about 7 dB in comparison with the case that the chamfering angle $\theta$ is zero. In summarizing the above results, a reduction efficiency of the impeller noise is dependent upon the chamfering construction, and when the chamfering width is in the range of 1.0–2.0 mm and the chamfering angle $\theta$ is 30 degrees, the impeller noise can be reduced most effectively.

Figure 4C:
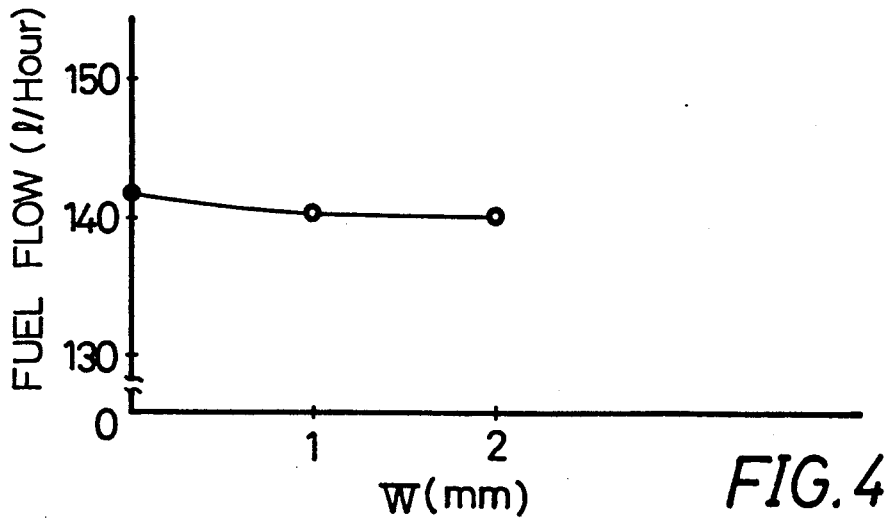
FIG. 4C is a graph showing the relationship between a fuel flow and a chamfering width according to the present invention.

The inventors also investigated the influence of the chamfering construction of the intersecting edges 54*a* upon a pump performance at ordinary temperature. That is, a fuel flow was measured under the condition where the chamfering angle $\theta$ is set to 30 degrees and the chamfering width W is varied. FIG. 4C shows the result of measurement under the pump operational condition of 11 V×3.3 kg/cm$^2$. As apparent from FIG. 4C, the fuel flow is reduced from about 143 liters/hour to about 140 liters/hour by the chamfering of the intersecting edges 54*a*. However, since a demanded lower limit of the fuel flow under the operational condition of 11 V×3.3 kg/cm$^2$ is 125 liters/hour, the value of about 140 liters/hour satisfies the demanded lower limit. Thus, although the pump performance is slightly reduced by the chamfering of the intersecting edges, it can be said that the influence of the chamfering upon the pump performance is ignorably small.

Figure 7:
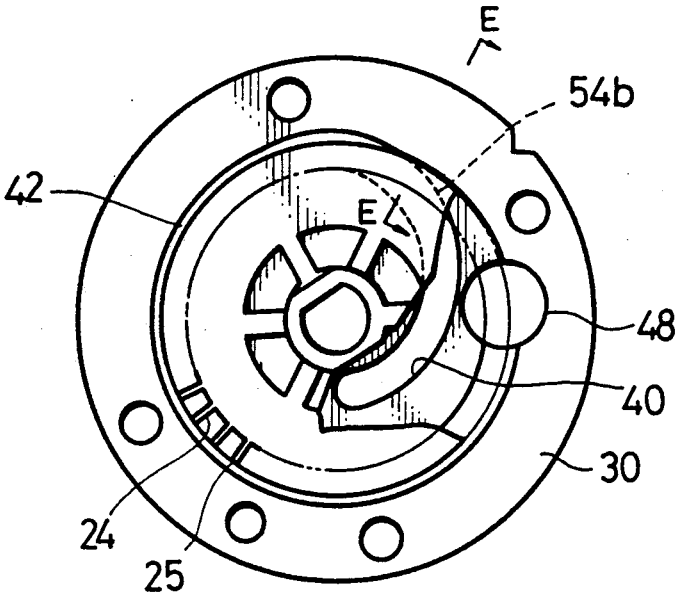
FIG. 7 is a view similar to FIG. 1, showing a third preferred embodiment of the present invention.
Figure 8:
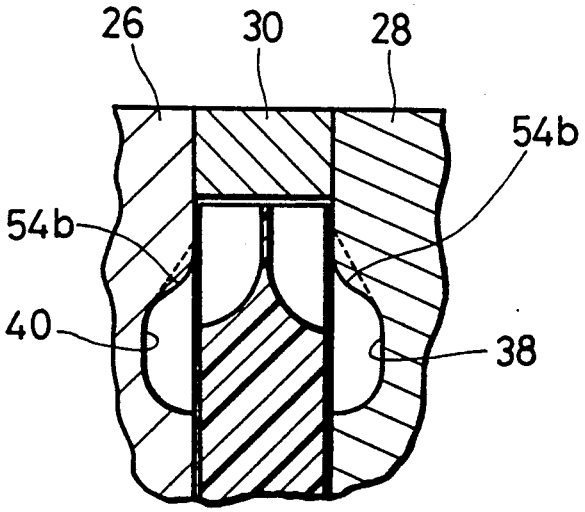
FIG. 8 is a cross section taken along the line E—E in FIG. 7.
Figure 17:
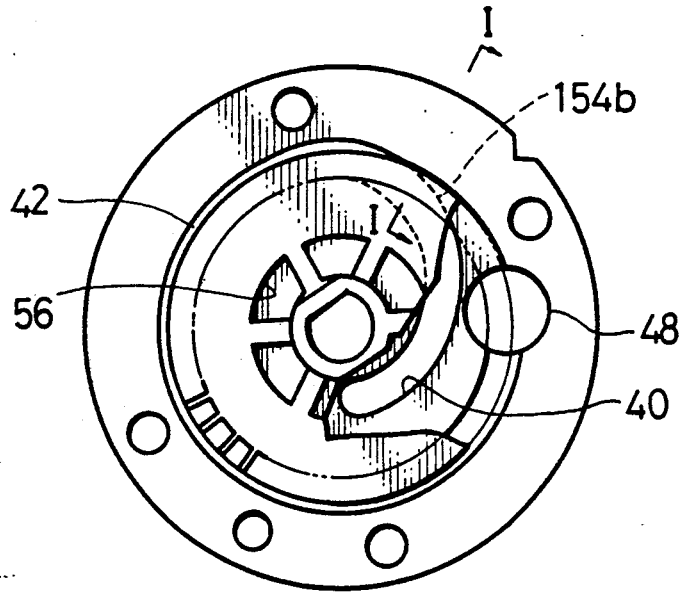
FIG. 17 PRIOR ART
FIG. 17 is a view similar to FIG. 13, showing a further modified construction of the fuel pump in the prior art.
Figure 18:
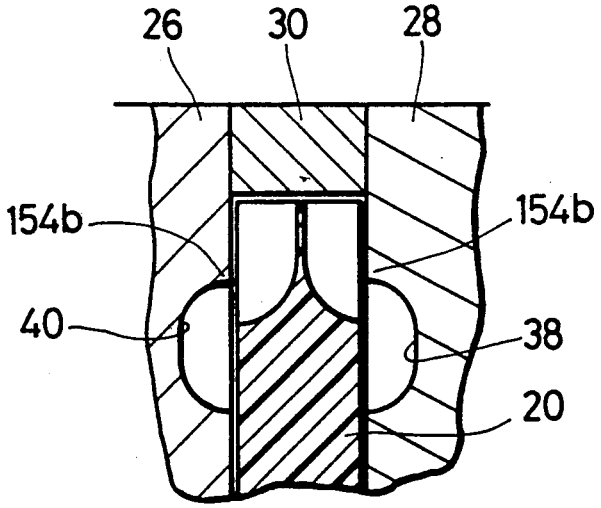
FIG. 18 PRIOR ART
FIG. 18 is a cross section taken along the line I—I in FIG. 17.
Figure 19:
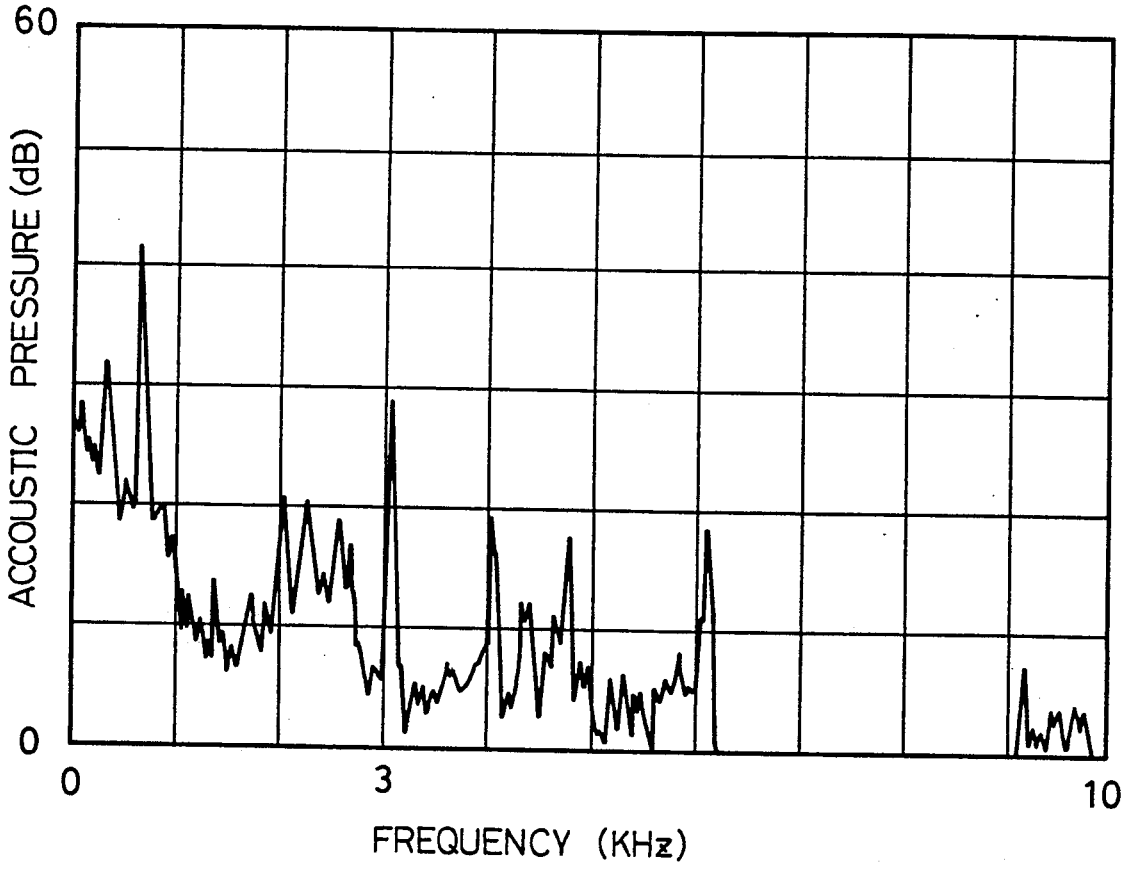
FIG.19 PRIOR ART
FIG. 19 is a graph similar to FIGS. 9 and 10, showing the measurement of the impeller noise in the prior art.

Referring next to FIGS. 7 and 8 corresponding to FIGS. 17 and 18, intersecting edges 54*b* of the fuel grooves 38 and 40 intersecting the vanes 25 of the impeller 20 are chamfered as best seen in FIG. 8.

Although in the first to third preferred embodiments, the intersecting edges of the fuel grooves 38 and 40 intersecting the vanes 25 of the impeller 20 are chamfered, the present invention may be applied to the construction where the intersecting edges of the fuel grooves 34 and 36 intersecting the vanes of the impeller 22 are similarly chamfered.

Figure 10:
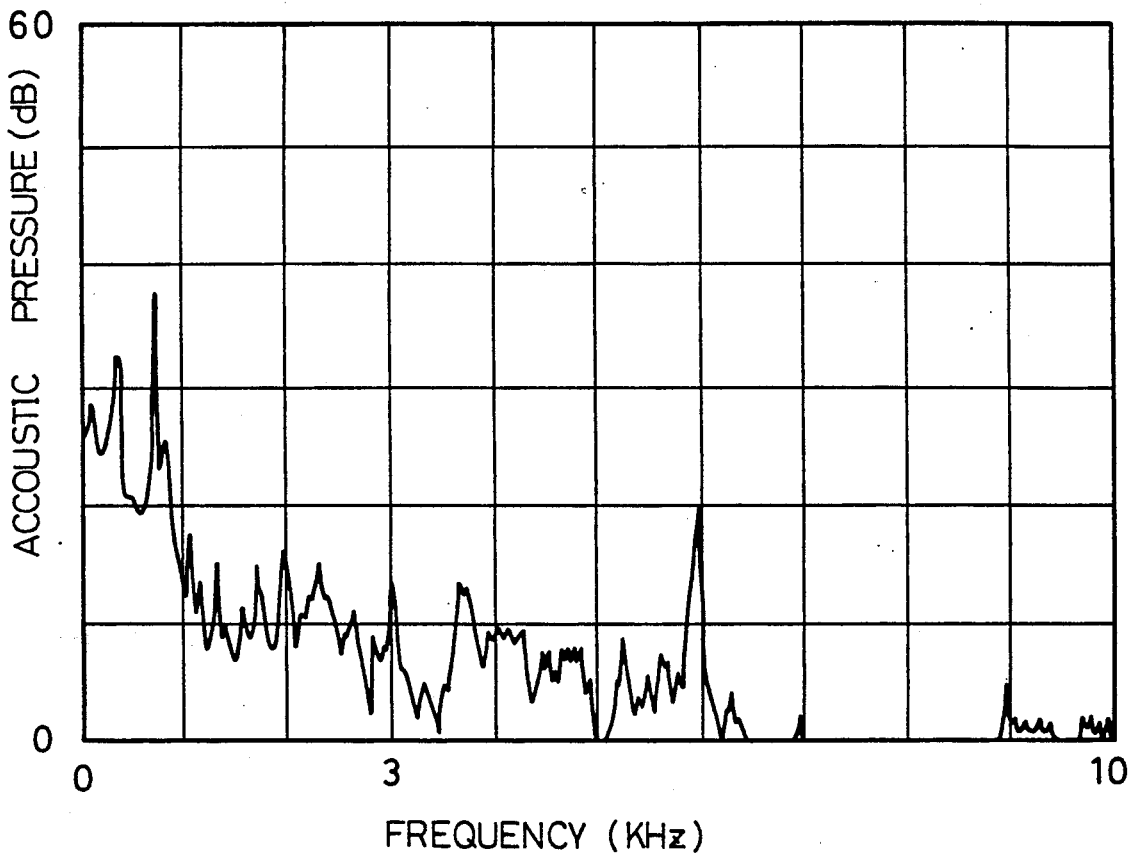
FIG. 10 is a graph similar to FIG. 9, showing the case that the present invention is applied to a pair of impellers.
Figure 11:
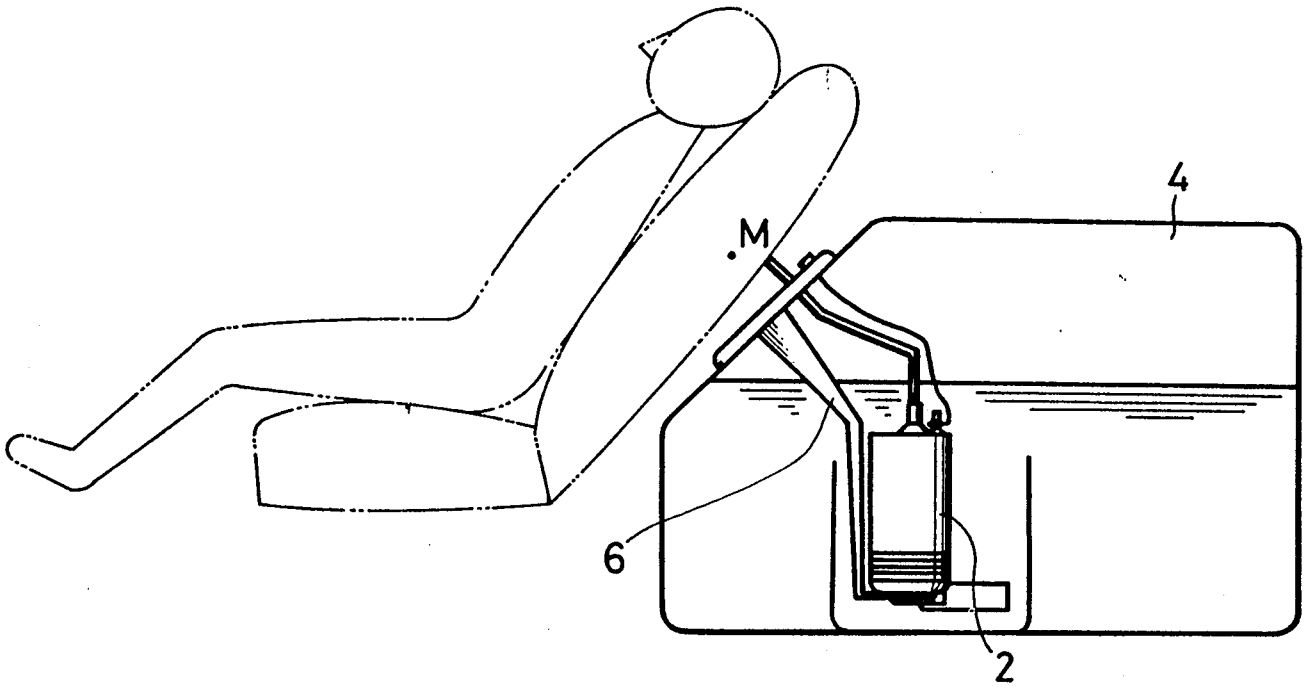
FIG. 11 PRIOR ART
FIG. 11 is a schematic illustration of the arrangement of the fuel pump.
Figure 12:
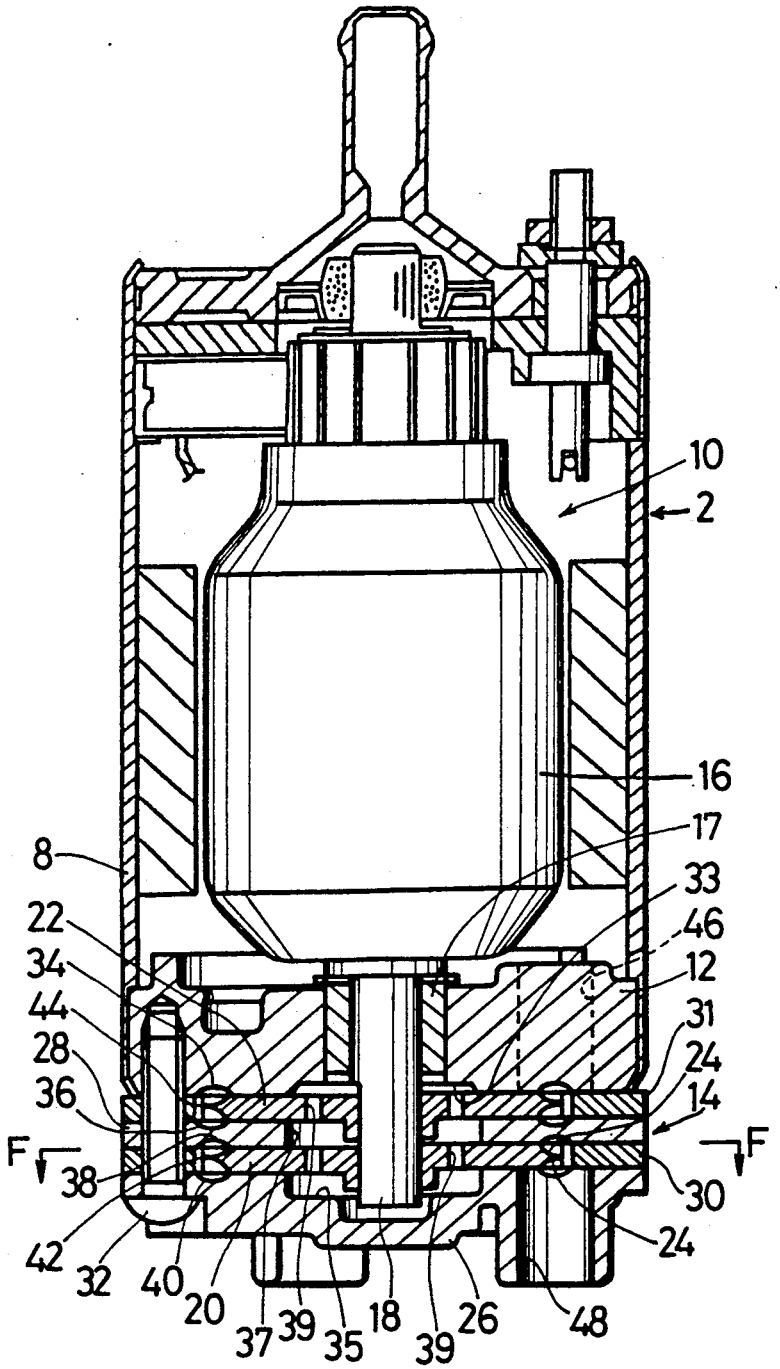
FIG. 12 PRIOR ART
FIG. 12 is a vertical sectional view of the fuel pump in the prior art.

FIG. 10 shows the result of measurement of the accoustic pressure in the case that the intersecting edges of all the fuel grooves 34, 36, 38 and 40 are chamfered in the fuel pump 2 of the second preferred embodiment. As apparent from FIG. 10 in comparison with FIG. 9, the accoustic pressure of the impeller noise at the frequency of 3 kHz is further reduced. Accordingly, a reduction efficiency can be more improved by applying the chamfering construction of the present invention not only to the fuel grooves 38 and 40 forming the first pump chamber 42 but also to the fuel grooves 34 and 36 forming the second pump chamber 44.

Further, although the sectional shape of the chamfered surface is arcuate as shown by a solid line in FIGS. 2, 3B and 8, it may be made straight as shown by a dotted line in these figures. Further, the number of the impellers is not limited to two according to the present invention.

Having thus described the preferred embodiments of the invention, it should be understood that numerous structural modifications and adaptations may be made without departing from the spirit of the invention.

What is claimed is:

1. A fuel pump comprising impeller means having a plurality of vanes at an outer circumference thereof and a wall member surrounding said vanes and formed with fuel groove means to define a pump chamber, said fuel groove means comprises an outer circumference, an inner circumference, an intake portion and a discharge portion, wherein a portion of an edge of said inner circumference of said fuel groove intersecting said vanes at said discharge portion is chamfered in order to reduce shearing noise generated when the impeller vanes move across said intersecting groove edge portion.

2. The fuel pump as defined in claim 1 wherein the discharge portion of said fuel groove means is diverted outwardly of the outer circumference of said vanes of said impeller.

3. The fuel pump as defined in claim 1 wherein the discharge portion of said fuel groove means is diverted inwardly of the outer circumference of said vanes of said impeller.

4. The fuel pump as defined in claim 1, wherein said impeller means comprises a first and second impellers arranged in opposed relationship to each other; and said wall member comprises an inlet member, an outlet member, a first annular spacer located around an outer circumference of said first impeller, an intermediate plate located between said first and second impellers, and a second annular spacer located around an outer circumference of said second impeller; and said fuel groove means comprises a first groove formed on said inlet member at a position opposed to said vanes of said first impeller, a second groove formed on said intermediate plate at a position opposed to said vanes of said first impeller, a third groove formed on said intermediate plate at a position opposed to said vanes of said second impeller, and a fourth groove formed on said outlet member at a position opposed to said vanes of said second impeller.

5. The fuel pump as defined in claim 4, wherein the intersecting edges of said first and second grooves intersecting said vanes of said first impeller are chamfered.

6. The fuel pump as defined in claim 5, wherein downstream end portions of said first and second grooves are formed along the outer circumference of said vanes of said first impeller.

7. The fuel pump as defined in claim 5, wherein downstream end portions of said first and second grooves are diverted radially outwardly.

8. The fuel pump as defined in claim 5, wherein downstream end portion of said first and second grooves are curved toward a center of said inlet member.

9. The fuel pump as defined in claim 4, wherein the intersecting edges of said first and second grooves intersecting said vanes of said first impeller are chamfered, and the intersecting edges of said third and fourth grooves intersecting said vanes of said second impeller are also chamfered.

10. The fuel pump as defined in claim 1, wherein a chamfered surface of said intersecting edges is configured into a sectionally arcuate shape.

11. The fuel pump as defined in claim 10, wherein a width of said chamfered surface is in the range of 1.0–2.0 mm and a chamfering angle of said chamfered surface is about 30 degrees.

12. The fuel pump as defined in claim 1, wherein a chamfered surface of said intersecting edge is configured into a sectionally straight shape.

13. The fuel pump as defined in claim 12, wherein a width of said chamfered surface is in the range of 1.0–2.0 mm and a chamfering angle of said chamfered surface is about 30 degrees.

* * * * *